United States Patent [19]

Abel et al.

[11] 4,078,473

[45] Mar. 14, 1978

[54] APPARATUS FOR PROTECTING A FLYING OBJECT POSITIONED IN A LAUNCHING TUBE

[75] Inventors: Alfred Abel; Juergen Meissner, both of Munich, Germany

[73] Assignee: Messerschmitt-Bolkow-Blohm GmbH, Munich, Germany

[21] Appl. No.: 742,897

[22] Filed: Nov. 18, 1976

[30] Foreign Application Priority Data

Nov. 29, 1975 Germany ..... 2553891

[51] Int. Cl.[2] ..... F41F 17/12

[52] U.S. Cl. ..... 89/31; 138/96 R

[58] Field of Search ..... 42/1 N; 89/1.817, 31; 138/96 R, 96 T

[56] References Cited

U.S. PATENT DOCUMENTS

| | | | |
|---|---|---|---|
| 44,631 | 10/1864 | Hull | 89/31 |
| 228,171 | 6/1880 | Boyd | 138/96 T |
| 3,063,184 | 11/1962 | Sokala | 42/1 N |
| 3,677,132 | 7/1972 | Plenge | 89/31 |

FOREIGN PATENT DOCUMENTS

| | | | |
|---|---|---|---|
| 9,099 of | 1900 | United Kingdom | 138/96 R |

*Primary Examiner*—Stephen C. Bentley

*Attorney, Agent, or Firm*—W. G. Fasse; W. W. Roberts

[57] ABSTRACT

A flying object, such as a missile is protected against shock loads, especially loads effective in the longitudinal direction, by a shock absorber which is secured to the muzzle end of a launching tube by an adapter ring. The absorber itself is a pipe section of relatively soft elastic material having embedded therein a helical insert of relatively hard elastic material.

5 Claims, 2 Drawing Figures

Fig.2
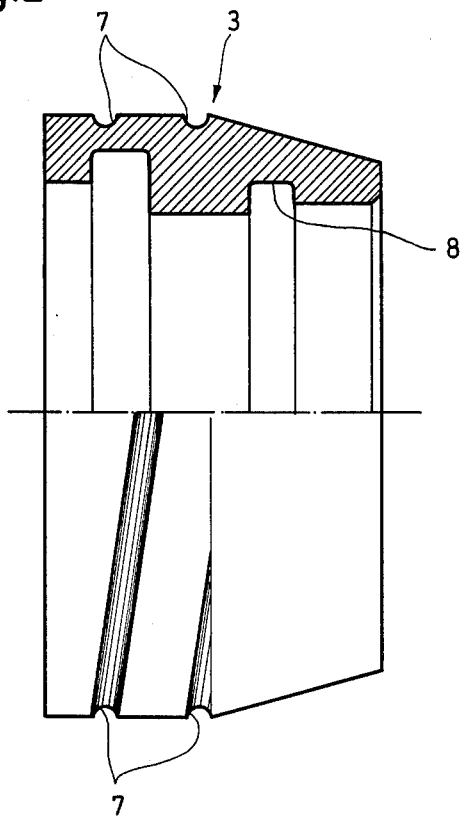
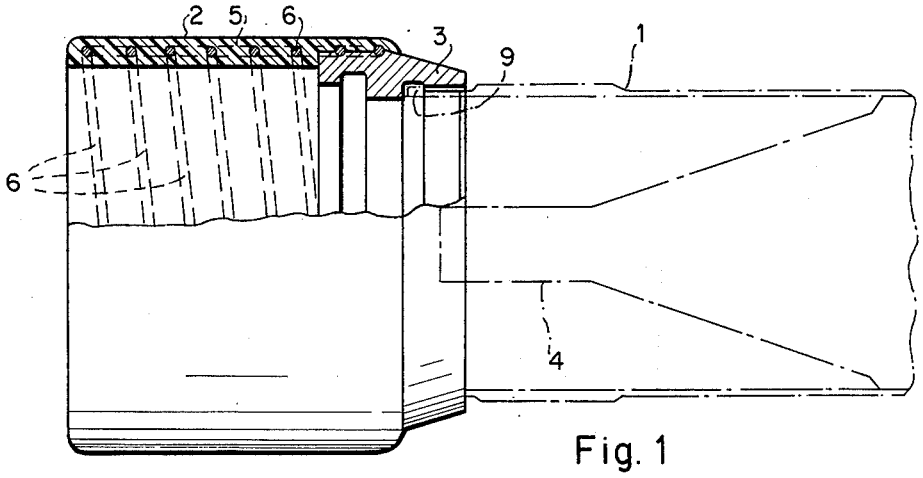
Fig. 1

APPARATUS FOR PROTECTING A FLYING OBJECT POSITIONED IN A LAUNCHING TUBE

BACKGROUND OF THE INVENTION

The invention relates to an apparatus for protecting flying objects, such as missiles, positioned in launching tubes, more specifically, the protection is to be provided against shock loads, especially such as are effective in the direction of the longitudinal axis of the flying object.

It has been the experience that the handling of flying objects positioned in launching tubes may quite frequently involve frontal or axial shocks to which the launching tubes are exposed. Such shocks may be so strong that ignition devices of the flying object may be actuated by the respective acceleration forces.

A shock protection device for a flying object is disclosed, for example, in German Patent Publication DOS 1,678,575. However, such shock protection device is arranged directly at the tip of the flying object and serves for the purpose to protect the flying object prior to its impact on the ground. This solution is not suitable for flying objects, the ignition device of which is located at the tip thereof. Besides, the known device is not effective to protect a missile in its launching tube.

German Patent Publication DOS 2,261,126 discloses pipes or hose material and methods for the production thereof. However, such known pipes or hoses are primarily used for conveying fluids, for example, air for a vacuum cleaner, heaters or air conditioners or water for shower outlets and the like. Hence, this prior art does not require further elaboration.

OBJECTS OF THE INVENTION

In view of the foregoing, it is the aim of the invention to achieve the following objects, singly or in combination:

to provide a protective device which will effectively protect a flying object, such as a missile in a launching tube against shock loads, especially those which occur during the transportation and during the handling;

to avoid prior art protecting devices which are arranged at the tip of the flying object and hence are lost with each firing;

to combine relatively hard elastic means and relatively soft elastic means in such a manner that an effective damping is assured of any loads that might be transmitted to the flying object positioned in the launching tube, and that the muzzle of the launching tube is protected.

SUMMARY OF THE INVENTION

According to the invention there is provided an apparatus for the protection of a flying object, especially one that is positioned in a launching tube, wherein the muzzle of the launching tube is extended by means of a pipe section made of a soft elastic material, which pipe section is provided with an insert of helical shape made of a hard elastic material.

The hard elastic insert in the shock protection device, according to the invention, takes up, in an elastic manner, even hard shocks, and the elastic take up is effectively dampened by the soft elastic envelope, whereby oscillation of the shock protecting apparatus is avoided. Moreover, the shock protector, according to the invention, is not lost with the launching of the flying object, because the shock protector is secured to the launching tube and not to the flying object.

Another advantage is seen in that, according to the invention, the shock protecting device does not have to be removed from the launching tube prior to the launching of the missile. Furthermore, the present shock protector prevents damage to the front end or muzzle of the launching tube which otherwise might be cause by frontal or axial shocks. Heretofore, such shocks could have damaged the muzzle to such an extent that further launching would be prevented. This drawback of the prior art has been overcome by the invention. The hard elastic insert makes sure that the shock protection device is returned automatically into its starting position even after severe shocks so that the launching or discharge of the flying object is not impeded by the protecting device.

BRIEF FIGURE DESCRIPTION

In order that the invention may be clearly understood, it will now be described, by way of example, with reference to the accompanying drawings, wherein:

FIG. 1 shows a side view partially in section of the shock absorber, according to the invention; and FIG. 2 illustrates a partial sectional view through an adapter ring used for connecting the present protecting device to the muzzle of a launching tube.

DETAILED DESCRIPTION OF PREFERRED EXAMPLE EMBODIMENTS

FIG. 1 shows a partial section through the muzzle of a launching tube 1 holding a flying object 4. The muzzle end is extended by a shock protection device 2, which is secured to the muzzle end by an adapter ring 3 which is also shown in FIG. 2.

The protecting device 2 comprises a cylindrical body made of flexible material 5, for instance, silicon rubber, butylcaoutchouc or other synthetic materials having a relatively soft elastic flexibility.

A helical insert 6, for example, of spring steel is embedded in the cylindrical body 2. The helical insert 6 serves simultaneously as a threading and engages helical grooves 7 on the outer circumference of the adapter ring 3, as best seen in FIG. 2. Thus, the shock protector 2 is substantially rigidly secured to the adapter ring 3 due to the cooperation between the helical groove 7 and the helical spring insert 6.

The adapter ring 3 is also provided with an inner, recessed groove 8 which cooperates with a respective outer ridge 9 around the muzzle of the launching tube 1. The adapter ring 3 may fit onto the ridge 9 in a form-locking manner, for example, upon rotating the ring relative to the tube. A bayonet type catch may also be used, for example, to secure the ring 3 to the muzzle of the tube 1.

Although the invention has been described with reference to specific example embodiments, it is to be understood that it is intended to cover all modifications and equivalents within the scope of the appended claims.

What is claimed is:

1. An apparatus for protecting a flying object positioned in a launching tube having a muzzle, against axially directed shock loads, comprising extension pipe means made of soft elastic material and open at both ends, insert means made of hard elastic material embedded in said soft elastic material, and means connecting said extension pipe means to an end of said muzzle with said extension pipe means extending beyond said end of said muzzle said connecting means comprising an adapter ring member having a first end connectable to said launching tube and a second end connected to said insert means, wherein the outer surface of said second end of the adapter ring member is provided with connecting elements for cooperation with said insert, and wherein the inner surface of the first end of said adapter ring member is provided with a groove adapted to receive an outwardly extending ridge of the launching tube.

2. The apparatus of claim 1, wherein said insert means have a helical spring shape extending substantially throughout the length of said extension pipe means and forming at least partially a threading for connecting the extension pipe means to the muzzle by way of said connecting means.

3. The apparatus of claim 1, wherein said connecting means comprises a ring having external threads, said insert means comprising a helical spring embedded in said soft elastic material and extending substantially throughout the length of said extension pipe means, said helical spring being radially inwardly exposed at the end of said extension pipe means toward said muzzle and forming internal threads threaded on said connecting means.

4. The apparatus of claim 3, wherein said helical spring is embedded radially inwardly and outwardly in said soft elastic material in the portion thereof extending from said ring away from said muzzle.

5. The apparatus of claim 1, wherein the outer surface of said first end of said adapter ring member tapers conically toward the launching tube.

* * * * *